United States Patent [19]

Hill

[11] Patent Number: 4,610,102

[45] Date of Patent: Sep. 9, 1986

[54] VELCRO-ENCAPSULATED LABEL FOR SHOES AND THE LIKE

[76] Inventor: Steven C. Hill, 12 Wynridge Rd., Windham, N.H. 03087

[21] Appl. No.: 782,310

[22] Filed: Oct. 1, 1985

[51] Int. Cl.[4] ..... A43B 23/24

[52] U.S. Cl. ..... 36/136; 36/1; 2/DIG. 6

[58] Field of Search ..... 36/136, 1, 45; 2/DIG. 6

[56] References Cited

U.S. PATENT DOCUMENTS

| | | | |
|---|---|---|---|
| 1,952,409 | 3/1934 | Berg | 36/136 X |
| 2,801,477 | 8/1957 | Adams et al. | 36/136 |
| 3,537,108 | 11/1970 | Daniels | 2/DIG. 6 |
| 4,280,287 | 7/1981 | Gulbransen | 36/136 |

OTHER PUBLICATIONS

*New Body,* Jul. 1984.

*Primary Examiner*—James Kee Chi

*Attorney, Agent, or Firm*—Robert K. Tendler

[57] ABSTRACT

The heel of the shoe, sneaker or other footwear is provided with a Velcro patch at the heel, with the Velcro patch having a cut-out window to accommodate an identification tag, label or health information card, with the label in the cut-out and the Velcro attached to the heel of the shoe being overlain with a releasably-attached flap having Velcro which mates with the shoe-mounted Velcro to form a fluid tight seal about the tag or indicia-carrying label, the heel mounting and the Velcro seal preventing the tag from coming loose from the shoe due to the interaction of the Velcro parts and due to the fact that the heel provides the least flexible area and the least wear receiving area for the shoe. The identity of the individual and other information on the tag is obtained from lifting the flap.

4 Claims, 5 Drawing Figures

VELCRO-ENCAPSULATED LABEL FOR SHOES AND THE LIKE

FIELD OF INVENTION

This invention relates to the carrying of identification or other indicia on one's person and more particularly to indicia to be carried by a shoe, sneaker or other footwear of an individual.

BACKGROUND OF THE INVENTION

For some time now the identification of injured or unconscious runners or runaway children has been a problem and there have been many attempts to provide identification indicia in various garments worn by such individuals. With respect to both children and runners or other athletes, the utilization of wristbands containing indicia are uncomfortable and are often not used for this reason. Moreover, putting indicia in articles of clothing such as caps which are readily removable and are sometimes uncomfortable suffer from the same disuse. The result is many runners run without any identification whatsoever on their person, much less any indication of their physical health or medical information which might be required. Moreover children in general do not usually carry identification as a routine matter, so that, if lost, there is no ready way to return them to their parents or legal guardians.

In an effort to locate missing children and indeed to identify stricken runners or other athletes having no identification on them, municipalities have resorted to the utilization of fingerprinting in order to provide a means of identification for these individuals. Such is a time consuming process and is somewhat humiliating, degrading or otherwise traumatic for the children involved, if not for the adults.

On the other hand there is one article of clothing which is invariably worn, which does not impede to any great extent the activity of the individual, and is usually necessary to perform whatever activity the individual is involved in. This of course is the shoe or other footwear which, unless the individual is going barefoot, is always worn.

It is however with great difficulty that one is able to provide sufficient labeling on the shoe due to its's flexibility and wear-attacked or abraded parts. Moreover, because the shoe comes into contact with both mud, water and other forms of dirt or debris it is only with difficulty that magic marker labeling is at all effective. Additionally, labeling on any part of the shoe which flexes or comes in contact with the ground is subject to removal or abrasion which makes it relatively useless as a labeling device. In addition to abrasion, any labels that are attached with adhesives are subject to attack by moisture as well as the flexing of the label if mounted on most portions of a shoe or piece of footwear.

SUMMARY OF THE INVENTION

On the other hand it has been found that the placing of the label at the heel of the shoe and surrounding it with a Velcro patch cut out in the form of a window over the label, with a Velcro-fastened releasably secured flap over the label provides a uniquely secure and effective means of identifying an individual whether the individual be a child or a runner or other athlete, when the flap is lifted to expose the label.

Velcro refers generally to a hook and loop structure which when pressed together provides that two parts carrying the Velcro are releasably joined. The reason for the security and advantages of utililzing such a label are that shoes or other footwear are normally always worn. Secondly, the cutout of the Velcro so as to form a window for the application of a label provides that the label is surrounded by a liquid tight seal, assuming the Velcro is sufficiently fine. Moreover, the placing of a flap over the label and securing it around the periphery of the window by the Velcro-to-Velcro mount provides increased protection against damage to the label and the information thereon.

Perhaps more importantly, the shoe is a wearable article which does not materially affect any activity of the individual. The individual may in fact forget that he is wearing a shoe or piece of footwear which identifies him or her. Thus providing identification on the shoe which is normally used is a failsafe method for providing identification, whether or not the individual is aware each and every time that he puts on the shoe that identification is available on the shoe.

In the case of runners who wish to run unencumbered, there is no wristlet or belt or article carrying indicia with can be weighty or uncomfortable, since the label is unfelt by the indvidual wearing the piece of footwear carrying the label.

Since the individual invariablely wears two shoes, one shoe can be provided with indicia indicating who the individual is, whereas the second shoe may carry medical information on the label which is critical to the treatment of the individual should the individual become involved in an accident or should the individual need any type of medical attention. Moroever, it is within the scope of this invention to provide a microchip in the window portion of the Velcro, whereby a great deal more information can be stored than can be readily printed in the small area of the heel. If required, microfilm may also be housed within the compartment comprising the cutout area of the shoe-carried Velcro strip and the overlying flap or cap.

In summary, an identification tag is provided on a shoe or other footwear which is mounted at the heel of the shoe, which is surrounded by a Velcro strip having a window so as to expose a heel-mounted label and is overlain with a flap of material carrying a Velcro inner liner which seals the enclosure formed by the window so as to protect the tag or label against the elements.

The heel mounting of the indicia-carrying device thus described is important because it is the area of the shoe or footwear which in general flexes the least and is least exposed to abraision or other wear factors. The utilization of the shoe itself as the indicia-bearing element is important due to its failsafe nature, in that both children and adult individulas invariably wear shoes, no matter what activity they are engaged in.

While the subject invention will be described in connection with the labeling of footwear, it will be appreciated that such a Velcro-enclosed tag or labeling system may be utilized elsewhere, with the surrounding Velcro encapsulation providing a liquid-tight seal as well as a dirt prevention mechanism for the label which may be adhesively attached to the garment or other structure involved.

Finally it should be noted that many running shoes, sneakers and the like are already provided with a flap of material at the heel of the shoe to which a logo is normally afixed. This flap, in a preferred embodiment, not only bears Velcro material on the interior surface thereof but also is hingedly attached to the top portion of the shoe via stitching or the like so as to even further prevent relative movement between the flap and the heel-carried Velcro. Additionally the securing of the upper edge of the flap to the upper portion to the heel of the shoe prevents any type of relative motion with the flexure of the heel such as may exist. The securing of the upper edge of the flap also prevents the flap from coming off when the heel is inadvertantly knocked against an object or provided with a blow, as from the other shoe.

BRIEF DESCRIPTION OF THE DRAWING

These and other features of the subject invention will be better understood in connection with the Detaild Description taken in conjunction with the drawings of which.

DETAILED DESCRIPTION

Figure 1:
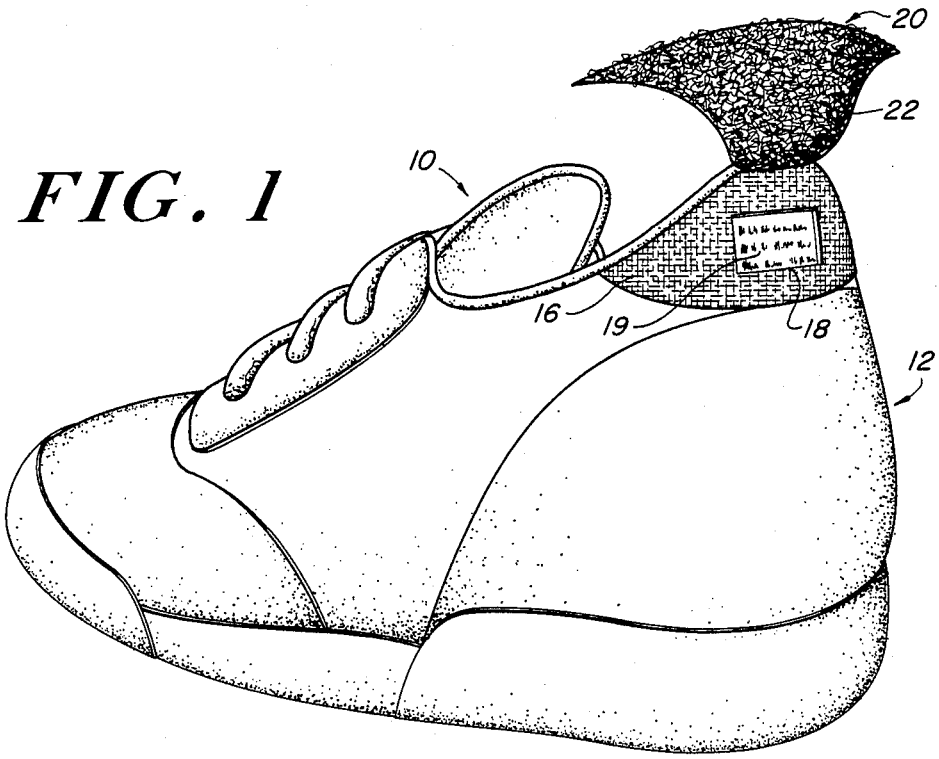
FIG. 1 is an isometric drawing of the subject invention in which a running shoe is provided with a Velcro-encased label at the upper heel portion thereof.

Referring now to FIG. 1 a piece of footwear 10 in the form of a running shoe is shown as including a heel 12 having an upper portion 14 to which is attached a precut strip 16 of Velcro material having a window 18 cut therein to expose the underlying portion of heel 12. Strip 16 may be attached to the upper portion of heel 12, either adhesively or by stitching as is convenient, with strip 16 being overlayed by a flap 20 of like configuration having interior surface 22 provided with Velcro-type material.

Window 18 carries a label 19, which may be any indicia-carrying a device and may be adhesively attached to the underlying heel material exposed through window 18. Here the label may be an adhesive label adapted to fit within window 18 and carry such information as the individual's identity, as well as any medical problems or other information as may be useful.

When flap 20 is closed over strip 16 it forms with window 18 and the surface of the heel portion of the shoe a compartment for the label or other device which is sealed against the elements about the periphery of window 18 so as to protect the label or like device. Moreover, when identification of the individual is desired flap 20 is flipped up as illustrated to expose the label and the identification thereon.

Figure 2:
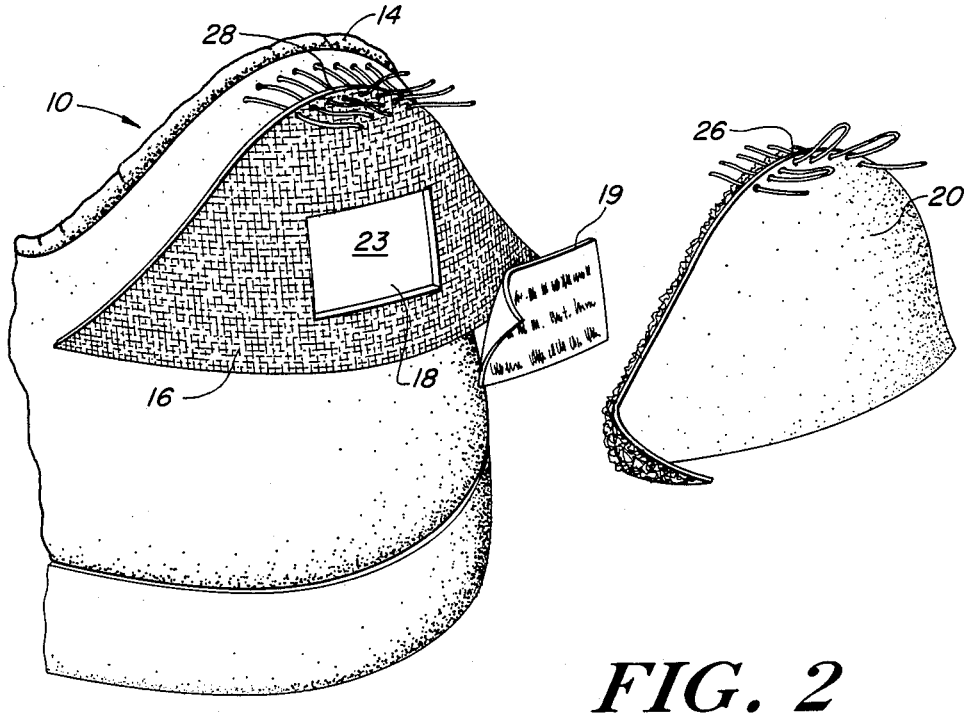
FIG. 2 is an exploded diagram of the subject invention illustrating that the heel-carried Velcro patch and the overlying flap are stitched at the top portion thereof to the top portion of the heel of the shoe, thereby to prevent loss of the flap and to provide added stability for the Velcro-encased label.

While, as illustrated in FIG. 1, flap 20 may be attached to the underlying Velcro strip solely by virtue of the Velcro hook and loop joinder, in a peelable fashion it is oftentimes convenient, as illustrated in FIG. 2, to stitch the upper portion 26 of flap 20 through the upper portion 28 of strip 16 to the upper portion 14 of shoe 10, thereby to add stability to the flap and to prevent loss of the flap should, the flap come loose or more commonly, be lost during the affixing of label 19 to material 23.

Figure 3:
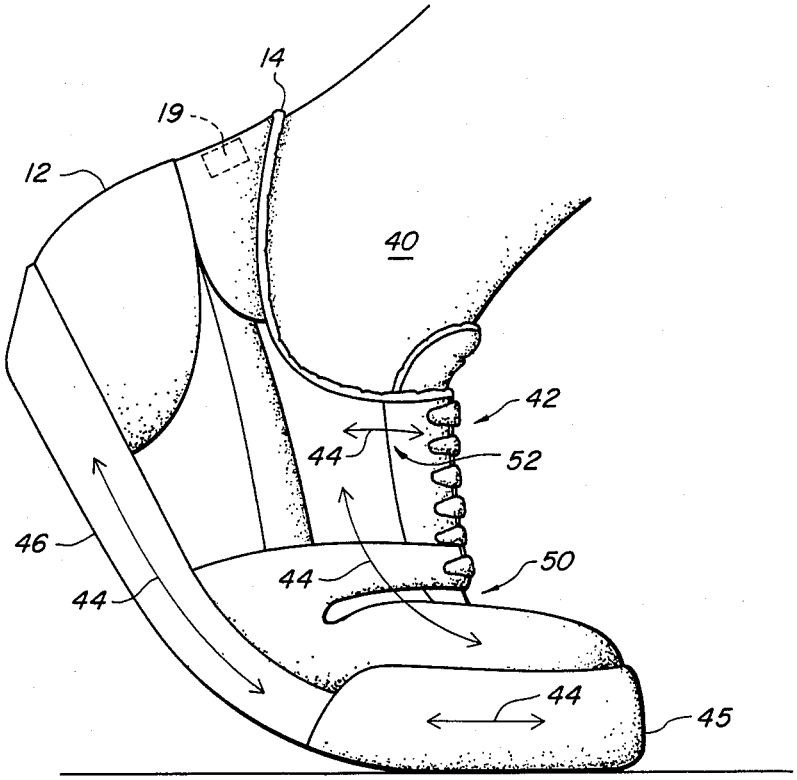
FIG. 3 is a diagramatic representation of an individual utilizing a sneaker-type piece of footwear showing points of flexure and wear.

As illustrated in FIG. 3 the foot 40 of an individual is shown having a sneaker or shoe 42 which bears the aforementioned label 24, here shown in dotted outline at the upper portion 14 of heel 12 of the shoe. As can be seen by arrows 44, during walking or running there is flexure of the shoe not only along its sole 46 or its toe 45, there is also flexure at the instep 50 and across the top portion 52 of the shoe. Because of the action and flexibility of the foot and the shoe it is undesirable to mount any labeling device at points of flexure or wear. Through testing it has been found that the upper portion 14 of heel 12 engenders the least amount of flexure and is exposed to the least amount of abrasion or striking blows as from a mating shoe. It is therefore an ideal location for the label or other indicia especially when the label or other indicia is enclosed within a Velcro-encased mounting.

Figure 4:
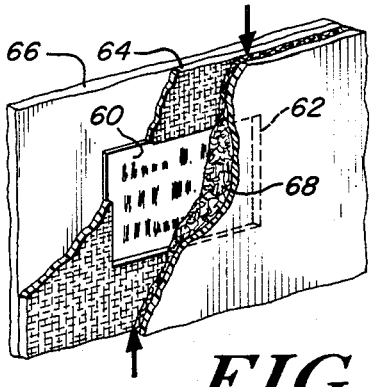
FIG. 4 is a diagrammatic representation of the utilization of the Velcro-encased label-containing structure for use with any type of article; and, FIG. 5 is a diagrammatic representation of a running shoe with a peelable flap.

Referring now to FIG. 4 a label or other information-carrying device 60 may be mounted in a window 62 within a layer 64 mounted on a structure 66, which layer 64 carries an outwardly extending Velcro hook and loop structure. Layer 64 is overlain by layer 68 which has on its underneath side a mating Velcro loop on pile hook and loop structure, such that, in general, the label is surrounded by a liquid-tight sealing mechanism which is readily removable to permit placement or replacement of the label on any article or structure. It is therefore within the scope of this invention that an identification or indicia-carrying device may be encapsulated at least on three sides by Velcro to permit the sealing of such label or device in a cavity which is surrounded on three sides by Velcro and which is supported by some other type of substrate which exists within the window portion of the layer which is cut out to accommodate the indicia-bearing structure.

Figure 5:
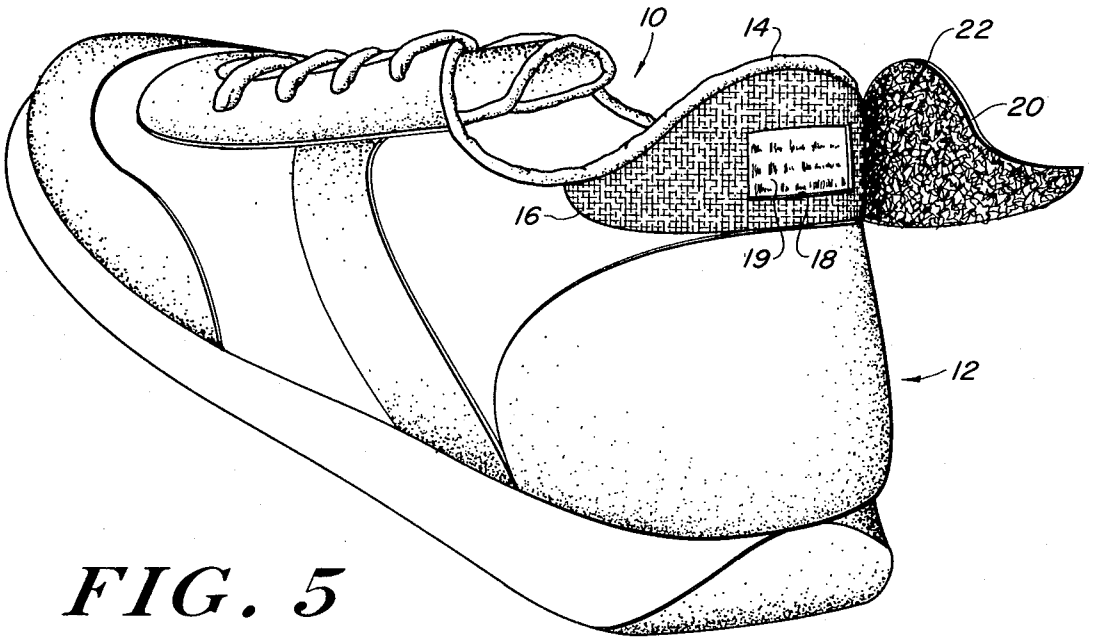

As mentioned before, FIG. 5 shows an embodiment in which flap 20 is fully peelable from the heel of a shoe to indicate that in some applications stitching or mechanical fastening by other than Velcro is not necessary.

Having above indicated a preferred embodiment of the present invention, it will occur to those skilled in the art that modifications and alternatives can be practiced within the spirit of the invention. It is accordingly intended to define the scope of the invention only as indicated in the following claims:

I claim:

1. Apparatus for use in the identification of an individual, comprising:

a hook and loop extensive patch mounted to said heel portion and having an aperture therein to form a cutout window which exposes a surface of said heel portion therethrough while at the same time, providing extensive hook and loop closure to prevent the elements from entering;

an overlying flap of material having a hook and loop inner structure, said flap adapted to be releasably secured to said hook and loop patch; and, an indicia-carrying device mounted within said aperture such that when said indicia-carrying device is so mounted, and the overlying flap is secured to the underlying patch, said indicia-carrying device is sealed on all sides against moisture and other elements to the heel of said piece of footwear, with the hook and loop encapsulation protecting the indicia-carrying device from the elements.

2. The apparatus of claim 1 wherein said indicia-carrying device is a label which is adhesively attached to the surface of the heel exposed through said aperture.

3. The apparatus of claim 1 wherein said flap of material includes means for securing the top edge thereof to the top edge of said heel portion of said footwear.

4. The apparatus of claim 1 and further including a pair of articles of footwear adapted to be placed on different feet of an individual, in which each of said articles of footwear bears an indicia-carrying device at the upper heel portion thereof, each of said indicia-carrying devices having a hook and loop material surrounding it and on top of it, with the underside of the indicia-carrying device being supported on the surface of a corresponding heal portion and being exposed through the corresponding aperture, whereby different pieces of information may be conveyed on different pieces of footwear of the pair.

* * * * *